US005896075A

United States Patent [19]

Kern

[11] Patent Number: 5,896,075

[45] Date of Patent: Apr. 20, 1999

[54] ELECTROMAGNETIC RELAY FOR HIGH THERMAL LOAD

[75] Inventor: Josef Kern, Berlin, Germany

[73] Assignee: Siemens Aktiengesellschaft, Munich, Germany

[21] Appl. No.: 08/993,225

[22] Filed: Dec. 18, 1997

[30] Foreign Application Priority Data

Dec. 19, 1996 [DE] Germany ..... 196 53 105

[51] Int. Cl.[6] ..... H01H 51/22

[52] U.S. Cl. ..... 335/78; 335/80; 335/82; 335/83; 335/128

[58] Field of Search ..... 335/78–86, 128, 335/124; 200/343

[56] References Cited

U.S. PATENT DOCUMENTS

| | | | |
|---|---|---|---|
| 4,480,162 | 10/1984 | Greenwood | 200/181 |
| 4,535,311 | 8/1985 | Okihara et al. | 335/124 |
| 4,684,909 | 8/1987 | Dittman | 335/128 |
| 4,734,668 | 3/1988 | Dittmann | 335/128 |
| 5,627,503 | 5/1997 | Mader | 335/78 |

FOREIGN PATENT DOCUMENTS

| | | |
|---|---|---|
| 0 383 226 B1 | 4/1989 | European Pat. Off. . |
| 23 48 423 | 12/1975 | Germany . |
| 698 08 162 | 12/1993 | Germany . |
| WO 90/09028 | 8/1990 | WIPO . |

*Primary Examiner*—Michael L. Gellner
*Assistant Examiner*—Tuyen T. Nguyen
*Attorney, Agent, or Firm*—Hill & Simpson

[57] ABSTRACT

A relay has a coil form, preferably made of ceramic, with a winding and a U-shaped core yoke, whose ends are bridged by a flat armature. The armature actuates an insulating switching spring, made of ceramic or a similar material, which bridges two counter-contacts with a bridge contact on its movable end. The relay can be used at high ambient temperature, even with a very small construction.

18 Claims, 3 Drawing Sheets

ELECTROMAGNETIC RELAY FOR HIGH THERMAL LOAD

FIELD OF THE INVENTION

The present invention relates to electromagnetic relays and, more specifically, to electromagnetic relays that include a switching spring with a bridge contact disposed at one end of the switching spring. The bridge contact is conductive and, because the switching spring need not conduct any load current, the switching spring may be fabricated from an insulating material.

BACKGROUND OF THE INVENTION

A relay having a coil form that serves as a basic element, a U-shaped core yoke, and a plate-shaped armature is known from the document WO 90/09028. The switching spring is connected directly with the armature, and in addition the switching spring is welded to the yoke via an angled-off segment. The switching spring thus serves both as an armature bearing spring and as an electrical terminal for the movable contacts.

With the use of such known relays with high thermal load, i.e. with high ambient temperature and/or with high self-heating by means of the coil current and/or a high load current, the cross-sections for the load circuit must up to now be overdimensioned in order to keep the power loss small. In addition, the coil must be designed with a high volume of winding wire for a small power loss. The contact and armature reset spring required in the conventional design must be constructed from a material with a low relaxation characteristic at high temperatures, e.g., from an expensive beryllium-alloyed copper spring material. These parameters set physical limits on the miniaturization of electromagnetic relays for large loads at high ambient temperatures.

SUMMARY OF THE INVENTION

The present invention provides an electromagnetic relay having:

- a U-shaped core yoke bearing a coil form with a winding,
- a flat armature that bridges the free ends of the core yoke, dependent on the coil excitation,
- a switching spring in the form of an elongated strip, arranged in the region of the armature, in a plane parallel to this armature, said spring being fastened at its one end and bearing at least one movable contact element at its other end, and
- having at least one pair of stationary counter-contact elements, which are bridged by the switching spring in one of its switching positions.

The object of the present invention is to manufacture a relay of the type named above with as simple a construction as possible and as few individual parts as possible, whereby the individual parts have a simple shape and can be joined with one another with as little processing as possible, so that economical materials are also used, and, according to one embodiment, the volume can nonetheless be kept small. An advantage of the invention is that the relay is suited in particular for applications with high thermal load.

In an embodiment, this object is achieved in a relay of the type named above, in that the switching spring is made of a highly insulating material with high spring rigidity and a low relaxation characteristic at high temperatures.

In an embodiment, the switching spring includes, at its contacting end, a bridge contact element made of highly conductive material.

In an embodiment, the armature engages with the switching spring immediately when switching takes place.

It is an advantage of the present invention that the switching spring itself thus need not conduct any load current, since this current flows only via the bridge contact at its end.

Another advantage is that the switching spring need not take over any bearing function for the armature, and thus also does not need to be bent, and can thus be made from relatively rigid material in the simplest shaping, without subsequent processing. Possible materials thereby include high-temperature-proof plastic materials, but preferably a ceramic material.

In an embodiment, the contact spring is made from a flat ceramic strip with an elongated cross-section that is rectangular or nearly rectangular. It is preferably also fastened, independent of the armature, to a stationary part of the relay, preferably to the coil form, whereby the armature is not connected with it, but rather presses on it with a fastening segment when the relay is excited.

In an embodiment, a coil form serves as the basic element, bearing the coil between two coil flanges; the core yoke forms a core limb and a yoke limb parallel thereto, whose free ends align in the region of a first coil flange; the armature is mounted in freely movable fashion in the first coil flange, and the switching spring is fastened to this first coil flange. An arrangement is thereby advantageous in which the armature is arranged in a plane approximately perpendicular to the coil axis, and forms two working air gaps with the frontal sides of the core limb and of the yoke limb, whereby the switching spring is fastened in a peripheral region of the first coil flange and extends between the end segments of the core limb and the yoke limb, thereby crosses the armature in a plane approximately parallel to it, and bears the contact bridge in a peripheral region opposite the point of fastening.

According to the requirements of temperature resistance, the coil form can also be manufactured either from a highly filled plastic or, preferably, likewise from ceramic. The switching spring is thereby preferably fastened in a slot of the first coil flange, e.g. by a hard soldering. To produce a bracing of the switching spring to the armature, it can be fastened obliquely in the slot. Furthermore, a particularly simple construction results by arranging the armature, without a bearing fastening, in the form of a more or less rectangular plate in a recess of the first coil flange, and securing it by means of mounting projections. A captive mounting of the armature can preferably be achieved by providing it with a target bending point, by means of which it is set in a slightly buckled state between mounting projections, and is brought into a straight state by means of subsequent bending.

Other objects and advantages of the present invention will become apparent upon reading the following detailed description and appended claims, and upon reference to the accompanying drawings.

BRIEF DESCRIPTION OF THE DRAWINGS

The invention is explained in more detail below in relation to an exemplary embodiment based on the following drawings.

Figure 1:
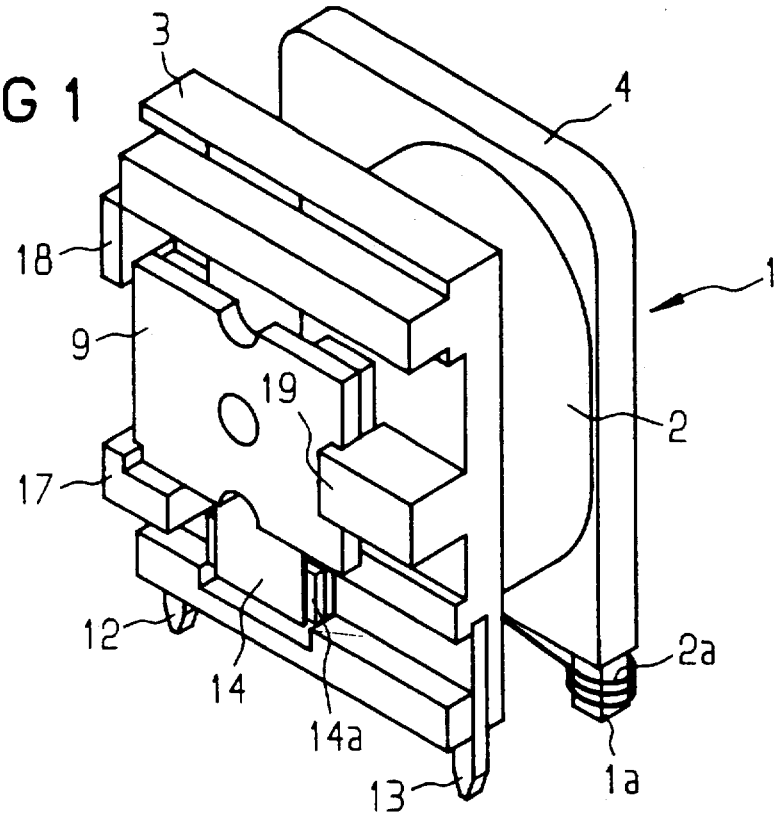
FIG. 1 is a perspective view of a relay constructed in accordance with the present invention.

It should be understood that the drawings are not necessarily the scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

The relay shown in the drawing has a coil form 1 made of ceramic material, which serves at the same time as basic element and bearer for the functional elements. A coil winding 2 is attached to the coil body 1; the winding 2 is limited by a first flange 3 and a second flange 4. A U-shaped core yoke 5 is plugged with a core limb 6 through an axial opening 7 of the coil form 1, while one yoke limb 8 extends parallel thereto alongside the coil. The core limb 6 and the yoke limb 8 form frontal pole faces 6a and 8a that align with one another, which, together with a plate-shaped armature 9, form two working air gaps.

The coil form 1 is made of ceramic material, and is preferably manufactured with the powder spray casting method. In addition, two coil terminals **1*a* are integrally formed immediately on the second flange 4, so that they can be directly wound with the winding ends 2*a* of the coil 2. By this means, the temperature-resistant coil form 1** can be soldered immediately into a circuit board.

In the first coil flange 3, two drawer-type receiving areas 10 and 11 are formed in the vicinity of the underside, into which, from opposite sides, two counter-contact bearers 12 and 13 with counter-contacts **12*a* and 13*a* are received. In addition, a ceramic spring is provided as a switching spring 14 with a simple rectangular shape, fixed with one end in the upper region of the first coil flange 3 in a slot 15 fashioned there. The fastening can thereby be carried out for example by means of soldering, sealing or ceramic cement. At its other end, the switching spring 14 has a transverse contact strip that works as a bridge contact 14*a* together with the two stationary counter-contacts 12*a* and 13*a*, and thus bridges these when the armature is attracted (see FIG. 3). The bridge contact 14*a* can be connected by means of a soldering with the switching spring 14, which is pre-galvanized in this region. The flat switching spring 14** is clamped on so as to project outward obliquely, in such a way that it receives a prestressing toward the armature and supplies the required reset force for this armature.

The armature 9 is arranged in freely movable fashion in a recess 16 left open in the coil form flange 3, and is captively secured on all sides by means of stops and mounting projections 17, 18 and 19. The mounting projection 19 includes a ledge under which the armature 9 is trapped. In the center, it has a crowned pressure projection 20, with which it actuates, in the crossover point, the switching spring, which is arranged so as to be rotated 90° to the longitudinal extension of the armature 9. In the example shown, the force of the magnetic system is transmitted to the bridge contact **14*a* with an approximate transfer ratio of 2:1. In the non-excited state of the armature 9, the spring 14 presses the armature against the stop projections 17, 18 and 19**.

Figure 5:
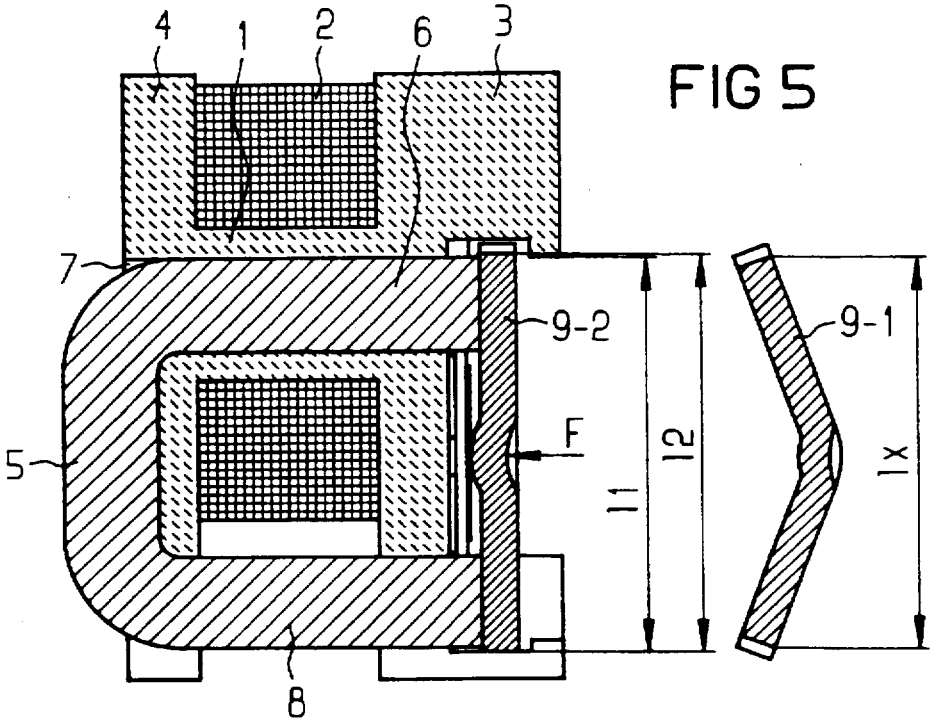
FIG. 5 is another sectional view taken substantially along line IV—IV of FIG. 3 partially illustrating the armature mounting.
Figure 2:
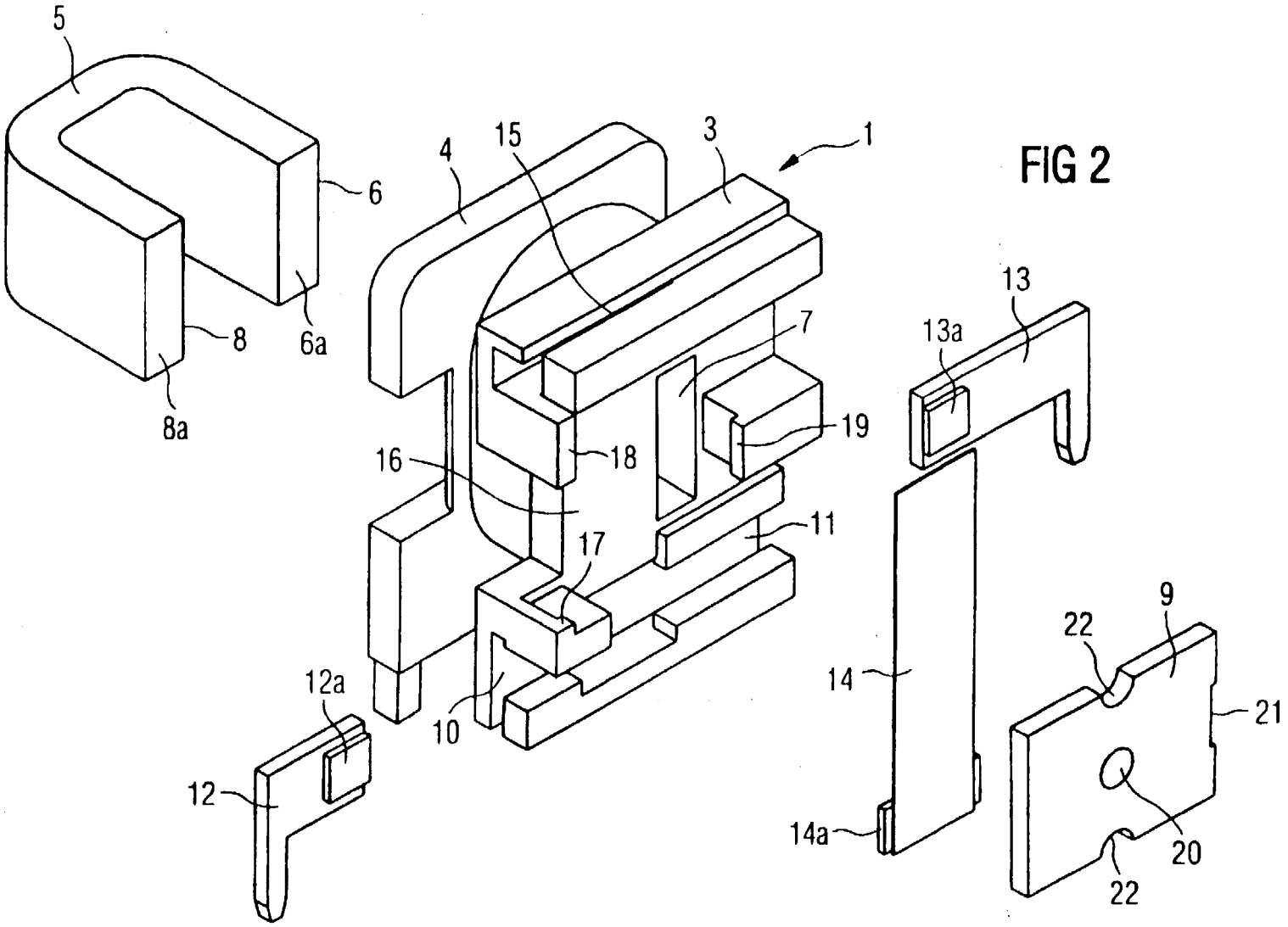
FIG. 2 is an exploded view of the individual parts of the relay first shown in FIG. 1.

The assembly of the armature 9 ensues, according to the schematic representation in FIG. 5, in such a way that it is first angled off in a V shape (state 9-1); in this state, the length 1x of the armature is shortened in the region of a lateral recess 21 in such a way that 1x is smaller than the length 11, which designates the opening length of the recess 16 on the mounting projection 19. Thus, in the state 9-1 the armature can be inserted past the mounting projection 19 into the recess 16. Subsequently, the armature is deformed by the attack of a force F from the back side of the actuating projection 20, along a target bending point formed by a weakened section 22, until a predetermined overtravel is reached; in this state it is approximately flat, and assumes the length 12. With this length 12, it is held captively behind the mounting projections 17, 18 and 19.

In this described assembly step, the time at which the contact closes is acquired, so that by means of a defined overpressure the required overtravel is set as security against contact erosion. By means of the crossed arrangement of the switching spring 14 to the armature, whereby the switching spring 14 does indeed lie in a plane parallel to the armature, but however is arranged with its longitudinal extension rotated by 90° in relation to the longitudinal extension of the armature, it is ensured that no inner fastening tensions, which could lead to breakage, arise in the relatively brittle but nonetheless sufficiently resilient ceramic switching spring. By means of this mentioned crossed arrangement of the spring to the armature, the arrangement of the armature at the two pole surfaces **6*a* and 8*a* is also not adversely affected, because the switching spring 14 lies in the free region between the end segments of the core limb 6 and of the yoke limb 8**.

Figure 3:
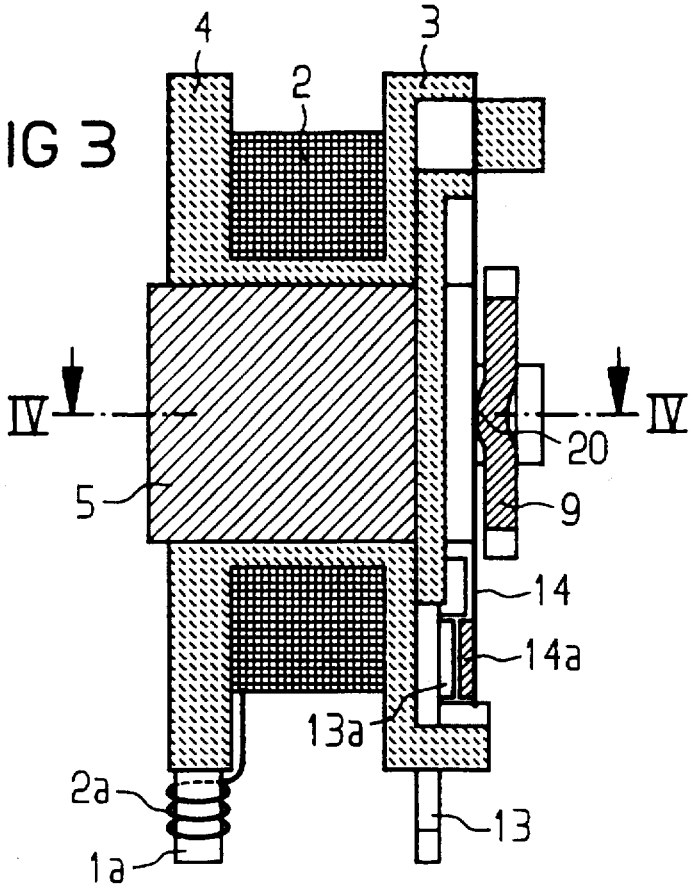
FIG. 3 is a section view taken substantially along line III—III of FIG. 4.
Figure 4:
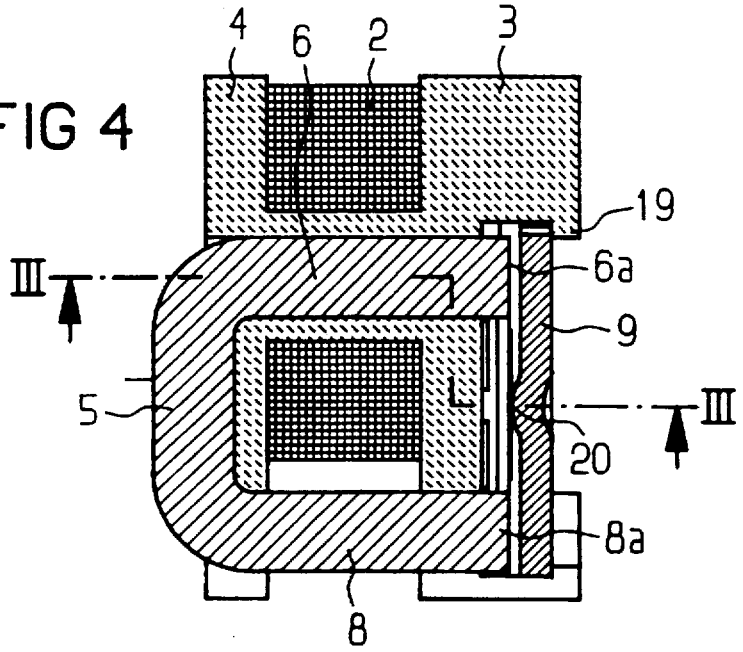
FIG. 4 is a sectional view taken substantially along line IV—IV of FIG. 3.

In FIGS. 3 and 4, sectional views taken substantially along lines III-III and IV-IV are shown in the longitudinal and transverse direction. By means of the functional planes and seating planes, lying in the first coil flange 3, of the functional parts of the relay, a high precision of the mechanical characteristic values of the relay is given, so that an adjustment can be omitted. Since a relaxation, and thus a later change of the mechanical characteristic values, at high temperatures is not to be expected, smaller paths and forces can be provided than in conventionally constructed relays, with the same life span. Anticipation of these parameters is thus not required. The relay can be operated at higher temperatures with a low-ohm coil. In comparison to conventional relays, the relay can be operated at high temperatures with smaller cross-sections for the electrical load circuit and the magnetic circuit. As a result, less material is consumed. It can thereby also be used at exposed locations with high ambient temperatures.

If the temperature stress is not too high, and a sintered ceramic base part is not required for the coil form, a coil body made of a highly filled thermoplastic, e.g. with mineral, ceramic or glass fillers, can be used. Of course, the relay can also be provided with SMT terminals as needed. Instead of the bridge make contact shown, the contact arrangement can also form a bridge break contact or a bridge changeover contact.

From the above description, it is apparent that the objects and advantages of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed:

1. An electromagnetic relay comprising:

a U-shaped core yoke comprising a core limb extending through a coil form and through a winding and terminating at a first pole end, the coil form defining a coil axis, the core yoke further comprising a yoke limb disposed outside of the coil form and the winding and terminating at a second pole end, the first and second pole ends being in a spaced juxtaposed relationship with a flat armature when the relay is in a non-excited state, the flat armature extending across the pole ends of the core yoke and perpendicular to the coil axis, the flat armature engaging a switching spring that is disposed between the armature and the coil form , the switching spring extending between the pole ends, the switching spring biasing the armature away from the pole faces when the relay is in the non-excited state to provide working air gaps between both pole faces and the armature, the switching spring comprising an elongated strip made from an insulating ceramic material with two opposing ends, the switching spring being disposed parallel to the armature, one end of the switching spring being connected to the coil form, the other end of the switching spring bearing at least one movable contact bridge element made from a conductive material, the switching spring having a high spring rigidity and a low relaxation characteristic at high temperatures, the coil form being connected to two spaced-apart counter-contact elements, the contact bridge element of the switching spring extending across the two counter-contact elements and engaging the two counter-contact elements in one of two switching positions.

2. The relay of claim 1 wherein the switching spring is made from a ceramic material.

3. The relay of claim 1 wherein the switching spring is connected to a stationary bearer element disposed on the coil form, the armature further comprising an outwardly protruding actuating segment, wherein when the relay is excited, the actuating segment of the armature engages engaging the switching spring.

4. The relay of claim 1 wherein the coil form comprises two spaced apart first and second coil flanges, the winding being disposed between the first and second coil flanges, the first and second pole ends being in alignment with the first coil flange, the armature being mounted in freely movable fashion at the first coil flange, the switching spring being connected to the first coil flange.

5. The relay of claim 1 wherein the coil form is made from ceramic material and comprises spaced apart first and second coil flanges, one of the coil flanges comprising a slot for accommodating one end of the switching spring.

6. The relay of claim 5 wherein the slot clamps the switching spring obliquely and biases the switching spring towards the armature.

7. The relay of claim 1 wherein the armature comprises a rectangular plate, the armature being loosely mounted to the coil form by a plurality of mounting projections attached to the coil form.

8. The relay of claim 7 wherein at least one of the mounting projections comprises an inwardly extending ledge, the armature being trapped underneath the ledge and between the inwardly extending ledge and the coil form, the armature comprising a weakened section, the armature being mounted underneath the ledge by bending the armature along the weakened section.

9. The relay of claim 1 wherein the coil form further comprises a coil terminal pin to which winding ends of the coil are fastened, the coil terminal pin being integrally connected to the coil form.

10. The relay of claim 1 wherein the armature comprises an integrally formed projection for engaging the switching spring.

11. An electromagnetic relay comprising:

a U-shaped core yoke comprising a core limb extending through a coil form and through a winding having a coil axis, the core limb terminating at a first pole end, the core yoke comprising a yoke limb disposed outside of the coil form and the winding, the yoke limb terminating at a second pole end, the first and second pole ends being a spaced juxtaposed relationship with an armature with a working air gap being disposed between each pole and the armature when the relay is in a non-excited state, the armature extending across in front of the pole ends and perpendicular to the coil axis, the armature comprising a projection for engaging a switching spring that is disposed between the armature and the coil form, the switching spring extending between the pole ends, the switching spring biasing the armature away from the pole faces when the relay is in the non-excited state to provide working air gaps between both pole faces and the armature, the switching spring comprising an elongated strip made from an insulating ceramic material with two opposing ends, the switching spring being disposed parallel to the armature, one end of the switching spring being connected to the coil form, the other end of the switching spring bearing at least one movable contact bridge element made from a conductive material, the switching spring extending between the first and second pole ends and generally parallel to the armature, the switching spring having a high spring rigidity and a low relaxation characteristic at high temperatures, the coil form being connected to two spaced-apart counter-contact elements, the contact bridge element of the switching spring extending across the two counter-contact elements and engaging the two counter-contact elements in one of two switching positions.

12. The relay of claim 11 wherein the switching spring is connected to a stationary bearer element disposed on the coil form.

13. The relay of claim 11 wherein the coil form comprises two spaced apart first and second coil flanges, the winding being disposed between the first and second coil flanges, the first and second pole ends being in alignment with the first coil flange, the armature being mounted in freely movable fashion at the first coil flange, the switching spring being connected to the first coil flange.

14. The relay of claim 11 wherein the coil form is made from ceramic material and comprises spaced apart first and second coil flanges, one of the coil flanges comprising a slot for accommodating one end of the switching spring.

15. The relay of claim 14 wherein the slot clamps the switching spring obliquely and biases the switching spring towards the armature.

16. The relay of claim 11 wherein the armature comprises a rectangular plate, the armature being loosely mounted to the coil form by a plurality of mounting projections attached to the coil form.

17. The relay of claim 16 wherein at least one of the mounting projections comprises an inwardly extending ledge, the armature being trapped underneath the ledge and between the inwardly extending ledge and the coil form, the armature comprising a weakened section, the armature being mounted underneath the ledge by bending the armature along the weakened section.

18. An electromagnetic relay comprising:

a U-shaped core yoke comprising a core limb extending through a ceramic coil form and through a winding defining a coil axis, the core limb terminating at a first pole end, the core yoke comprising a yoke limb disposed outside of the coil form and the winding, the yoke limb terminating at a second pole end, the first and second pole ends being spaced apart and facing an armature with a working air gap being disposed between each pole end and the armature when the relay is in a non-excited state, the armature extending across in front of the pole ends and perpendicular to the coil axis, the armature comprising a projection for engaging a ceramic switching spring that is disposed between the armature and the coil form, the switching spring extending between the pole ends, the switching spring biasing the armature away from the pole faces when the relay is in the non-excited state to provide working air gaps between both pole faces and the armature, the switching spring comprising an elongated strip made from an insulating ceramic material with two opposing ends, the switching spring being disposed parallel to the armature, one end of the switching spring being connected to the coil form, the other end of the switching spring bearing at least one movable contact element made from a conductive material, the switching spring extending between the first and second pole ends and generally parallel to the armature, the switching spring having a high spring rigidity and allow relaxation characteristic at high temperatures, the coil form comprising two spaced apart first and second coil flanges, the winding being disposed between the first and second coil flanges, the first and second pole ends being in alignment with the first coil flange, the armature being mounted in freely movable fashion at the first coil flange, the switching spring being connected to the first coil flange, the first coil flange comprising a slot for accommodating one end of the switching spring, the slot clamping the switching spring obliquely and biasing the switching spring towards the armature, the coil form being connected to two spaced-apart counter-contact elements, the contact element of the switching spring extending across the two counter-contact elements and engaging the two counter-contact elements in one of two switching positions, the armature being loosely mounted to the first flange of the coil form by a plurality of mounting projections attached to the first flange of the coil form, at least one of the mounting projections comprises an inwardly extending ledge, the armature being loosely trapped underneath the ledge and between the inwardly extending ledge and the coil form, the armature comprising a weakened section, the armature being mounted underneath the ledge by bending the armature along the weakened section.

* * * * *